US006357103B1

(12) United States Patent
Sikorski

(10) Patent No.: US 6,357,103 B1
(45) Date of Patent: Mar. 19, 2002

(54) METHOD FOR MAKING STAINED GLASS ARTICLES

(75) Inventor: William Joseph Sikorski, 2005 Karen Blvd., Longview, TX (US) 75602

(73) Assignee: William Joseph Sikorski, Longview, TX (US)

( * ) Notice: Subject to any disclaimer, the term of this patent is extended or adjusted under 35 U.S.C. 154(b) by 0 days.

(21) Appl. No.: 09/587,531

(22) Filed: May 30, 2000

(51) Int. Cl.[7] ..... B21B 1/46

(52) U.S. Cl. ..... 29/458; 29/527.2; 428/38; 156/63; 156/277

(58) Field of Search ..... 156/63, 277, 330, 156/100; 428/38, 13, 14, 39; 29/458, 527.2

(56) References Cited

U.S. PATENT DOCUMENTS 3,931,425 A * 1/1976 Kuroda ..... 428/38
4,127,689 A * 11/1978 Holt ..... 428/38
4,217,326 A * 8/1980 Goralnik ..... 264/254
4,302,260 A * 11/1981 Meltzer ..... 428/38
4,312,688 A * 1/1982 Brodis et al. ..... 428/38
4,318,946 A * 3/1982 Pavone ..... 428/38
4,335,170 A * 6/1982 Butler ..... 428/38
4,343,758 A * 8/1982 Goralnik ..... 428/38
4,438,165 A * 3/1984 Butler ..... 428/38
4,999,065 A * 3/1991 Wilfert ..... 156/277
5,039,468 A * 8/1991 Sellers ..... 428/38
5,217,791 A * 6/1993 Fujita et al. ..... 428/38
5,270,087 A * 12/1993 Polsky ..... 428/38
5,380,044 A * 1/1995 Aitkens et al. ..... 156/27
5,383,293 A * 1/1995 Royal ..... 40/768
6,022,599 A * 2/2000 Rietveld et al. ..... 428/13

* cited by examiner

*Primary Examiner*—David P. Bryant
*Assistant Examiner*—Jermie E. Cozart

(57) ABSTRACT

A simulated stained glass art object and a method for its production comprised of a wooden picture frame containing a pane of glass onto which a polymeric film bearing the art image is bonded and embedded with an epoxy resin. The art images are printed onto the film from a computer with an inkjet printer. The images are loaded into the computer either by scanning photographs or by uploading files from a digital camera. The glass pane may be modified to minimize reflected light or to absorb UV wavelengths. A mirror can be installed behind the art images to reflect light back through the images and to improve the appearance of the object when viewed.

4 Claims, 4 Drawing Sheets

METHOD FOR MAKING STAINED GLASS ARTICLES

STATEMENT REGARDING FEDERALLY SPONSORED RESEARCH AND DEVELOPMENT

Not Applicable

REFERENCE TO A "MICROFICHE APPENDIX"

Not Applicable

BACKGROUND OF THE INVENTION

1. Field of the Invention

This invention relates to decorative articles which simulate the esthetic effects of stained glass and a method for producing the articles.

2. Description of the Prior Art

Although the art of leaded glass or stained glass originated prior to the $9^{th}$ century, it did not flourish until the $12^{th}$ century when massive new cathedrals were being built. The art of stained glass declined somewhat during the Reformation of the $16^{th}$ century but it has been very popular since its revival by William Morris in the $19^{th}$ century. Traditional stained glass articles consist of individually cut pieces of glass joined by soldered H-shaped lead cames. The cut pieces of glass are colored or painted and produce a design when assembled. The traditional art is labor intensive and requires great skill. Art pieces produced in this manner are usually expensive.

Methods of simulating stained glass have been devised to overcome the inherent disadvantages of traditional leaded glass articles. Most simulation methods have focused on reducing the cost of the art and on making articles that are stronger and less susceptible to deterioration. The need in stained glass simulation is to not only remedy the disadvantages of the traditional art form but also to produce realistic looking stained glass articles.

Decorative panels and articles which simulate the appearance and effect of stained glass have been described in several patents. Early simulated stained glass articles were unconvincing because the simulated cames were unrealistic in color and dimensional effect (depth). The cames were applied 'flat' on the substrate of the article. More recent methods have improved the came simulation and have produced more aesthetic and realistic articles. Several prior art methods from the patent literature (US) are described to illustrate the state and evolution of stained glass simulation.

Kuroda, U.S. Pat. No. 3,931,425, described a simulation method in which a sheet of plastic material is provided black, textured color lines are applied to both sides in perfect registration. The spaces between the lines on one side are distressed to give a rough surface and are colored with transparent inks. This sheet is laminated to a second, clear plastic sheet.

Melzer, U.S. Pat. No. 4,302,260, described a method of simulating stained glass by joining pieces of colored, textured (one surface) plastic with a plastic adhesive. The product is assembled on a plastic sheet and removed as a single piece after the adhesive has set.

Brodis et al, U.S. Pat. No. 4,312,688, described a simulation method in which the product was built upon a glass product such as a window. Adhesive backed lead stripping is applied to form a pattern and trimmed. Colored plastic sheeting (cellophane) is cut to shape and applied to the inner surface of the window between lead strips. Lead stripping is applied to the inner surface in registration with the strips on the outer surface.

Butler, U.S. Pat. No. 4,335,170 and U.S. Pat. No. 4,438,165, described a simulation similar to that of Brodis et al but different in that the lead strips did not divide the pane into small segments.

Goralnik, U.S. Pat. Nos. 4,217,326 and 4,343,758, described a method in which glass pieces were placed into cames formed from epoxy resin and glued into place with epoxy resin.

Holt, U.S. Pat. No. 4,127,689, described a method in which the desired art work is silk-screened onto one surface of a thin plastic substrate. A coating is applied over the silk screening to generate optical distortion. A thermosetting plastic is used+i form cames on both sides of the substrate.

Pavone, U.S. Pat. No. 4,318,946, described a simulation method in which irregularly shaped, colored plastic members are bonded to a clear substrate of the same plastic. The areas between the members are filled with a latex grout. The surface of the product can be further treated to enhance the effect.

Sellers, U.S. Pat. No. 5,039,468, described a simulation method in which cames are fist molded from a master window in silicone rubber. Glass pieces are assembled and sealed in resin cames using a polyester resin in the silicone master molds.

Polsky, U.S. Pat. No. 5,270,087, described a simulation method in which colored, transparent inks are applied to one surface of a rigid plastic subs. An opaque coating is applied to the other side. Portions of the opaque coating are 'scratched-off' to reveal portions of the ink patterns.

Fujita, U.S. Pat. No. 5,217,791, described a complex simulation process in which a plastic film is coated with a mixture of pigments and adhesives designed to produce specified optical characteristics. The desired image is printed over the coating using an offset press. The printing inks pass through the coating. The printed sheet simulates the appearance of stained glass.

Many of the methods used to simulate stained glass art necessitate that the cames or the colored image or both be cut from a sheet of rigid, translucent plastic or other material. Intricate, detailed images cannot be created from 'puzzle-like' pieces. Some methods are very complex and rival the traditional stained glass process for labor and time while others produce a sandwich of two or three layers of plastic film laminated together. These methods are not practical for small (8.5"×11") art objects.

Thus it is an objective of the present invention to provide a method of simulating stained glass which uses images with very high detail and which does not use small pieces to form the image.

It is a further objective of the present invention to provide a method which utilizes an existing planar surface of glass as its substrate.

It is a further objective of the present invention to provide a method for simulation of stained glass that can be packaged and distributed as a complete kit.

It is a further objective of the present invention to provide a method for simulation of stained glass which does not require special skills and thus can be easily completed by the do-it-yourselfer.

SUMMARY OF THE INVENTION

The general purpose of the present invention is to provide a new method for simulating stained glass which has some of the advantages mentioned heretofore and which incorporates new, novel features that afford a stained glass simulation that is not suggested, anticipated, or implied by any of the prior art methods. This new simulation uses high resolution images, has the strength of a single pane of glass, is completely sealed, and provides from the deleterious effects of UV radiation. The invention is assembled upon the glass pane substrate of an ordinary (13.5"×11") picture frame. The glass pane of the frame is cleaned with distilled white vinegar and dried with a lint free paper towel. The image to be used for the art object is obtained by either photographing the desired scene with a digital camera or from an existing color photograph. The image is digitized by either uploading the digital camera image into a home computer or by scanning (high resolution) the color photograph into the computer. This image is printed (color, high resolution) onto polyester film (transparency) for use in the stained glass simulation. A commercial, two part epoxy resin is mixed (1 part resin to 1 part hardener) for use. One ounce of mixed resin is applied to the glass and leveled to seal the glass to the frame. The printed transparency is placed on the glass printed side against the glass) and three ounces of mixed resin are applied to the back of the transparency. The resin is leveled to embed (encapsulate) the transparency and allowed to cure. Frame stops are installed and the product is complete.

DETAILED DESCRIPTION OF THE INVENTION

Figure 1:
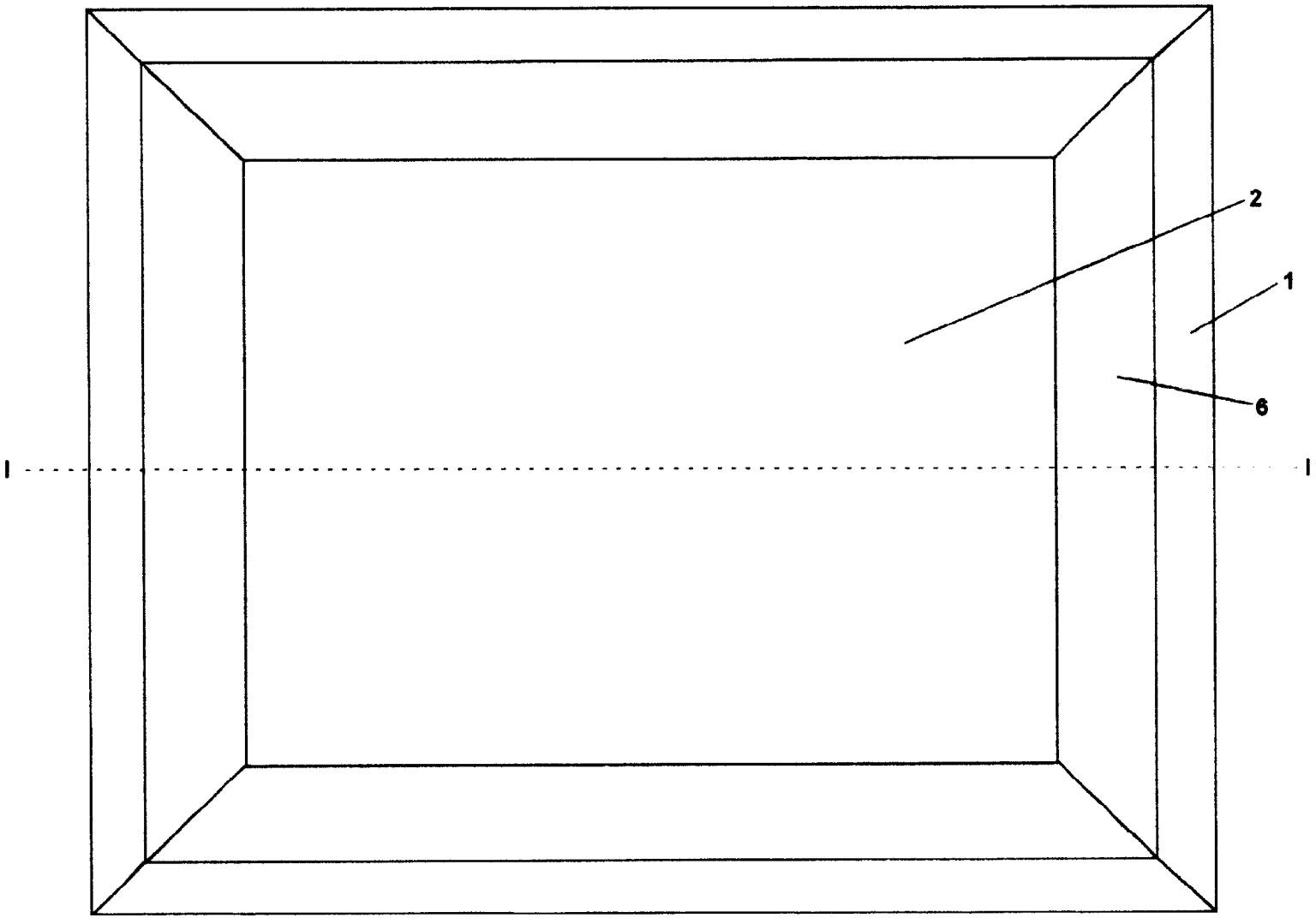
FIG. 1 is a top plan view of an assembled article produced by the present invention.

A representative, simulated stained glass article in the form of a framed picture prepared by the method of this present invention is shown in FIG. 1. Frame elements 1, wooden stops 6, and rigid glass pane 2 are shown in this figure. The art of the article lies just behind the glass 2 and is viewed by transmitted and reflected light from the glass.

Figure 2:
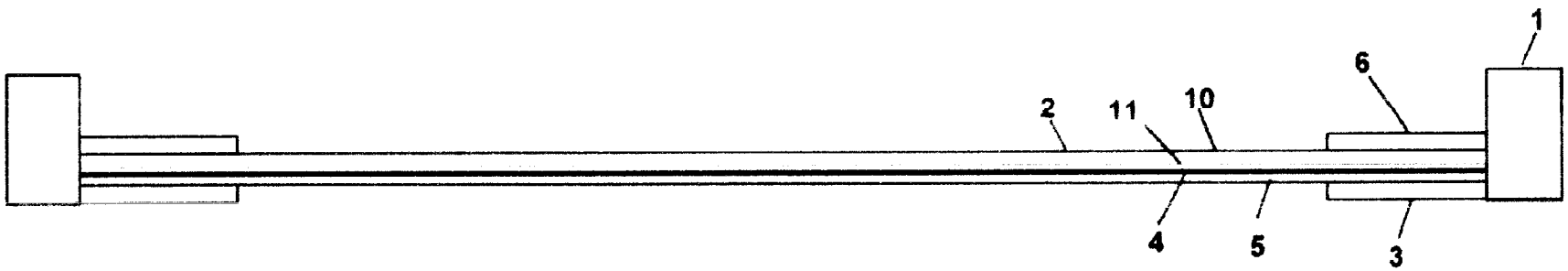
FIG. 2 is a cross sectional view of the stained glass article taken along line I—I of FIG. 1

FIG. 2 illustrates the components of the sealed assembly of the present invention. The manufacturing method to produce the simulated stained glass appearance from a two dimensional color photograph is comprised of a series of steps to generate a desired photograph and to integrate that photograph into the assembly of FIG. 2.

In a typical embodiment of the method, photographs are generated either by direct photography of the desired subject or from existing photographs or art in books or magazines. The preferred embodiment of direct photography is to use a digital camera from which the images can be up-loaded electronically to any computer having the appropriate port and software to handle photographs. An ordinary camera can be used to produce photographs. These photographs as well as art from books or magazines can be scanned into the computer with any high resolution, color, flatbed scanner. These steps take art from a variety of sources digitize it for use in a computer.

The art is transferred from the computer to a form useable in the method of the present invention by printing the images onto a clear, flexible, polyester film (transparency). Inkjet printers have been used to print the images. The print cartridges used in inkjet printers today have improved light stable and/or mutable ink compositions. The dye colorants still tend to fade over time when exposed to sunlight. Laser printers have not been used to print the images.

The simulated stained glass article is assembled into a wooden picture frame purchased from a custom frame shop. The ⅛" thick pane of clear glass is mounted on set of stops. In a preferred assembly method the simulated stained glass article is prepared by the following sequence of steps:

FIG. 2: both surfaces, 10 and 11, of glass pane 2 are cleaned with distilled white vinegar, air dried, and rubbed with a lint free paper towel.

Four ounces of a two part epoxy resin are mixed in a ratio of 1 part hardener to 1 part resin. The mixture is stirred carefully with a metal spatula to avoid incorporation of air into the resin. The preferred epoxy resin components contain a UV inhibitor.

One ounce of the mixture is applied to surface 11 of glass pane 2 and leveled by tilting the frame back-and-forth until the entire surface 11 is covered. The mixture flows into gaps between the frame and the glass and seals the glass to the frame (FIG. 2).

The printed polyester film 4 is applied to the resin coated surface 11 of the glass pane with the printed side down into the resin (FIG. 2).

The remaining 3 ounces of resin mix are applied to the exposed surface of the transparency 4 to embed the transparency in the epoxy resin 5 and to seal the system.

The epoxy resin embedding the transparency 4 is allowed to cure for 24 hours (FIG. 2).

The resin fills gaps between the two sets of wooden stops, 6 and 7, and embeds the art work of the article.

In other embodiments of the method of the present invention, simulated stained glass articles are prepared according to the steps heretofore outlined with the following singular changes made.

Tru Vue® Reflection Control glass is substituted for the glass pane 2 of the frame assembly.

Conservation glass with a protective UV coating is substituted for glass pane 2.

Clear resins such as polyester, etc. are substituted for the epoxy resin and used according to the manufacturers recommendations.

The transparency is printed onto a clear films other than the standard transparency film (mylar, special polyesters, etc.). The film must be compatible with the printer used.

Figure 3:
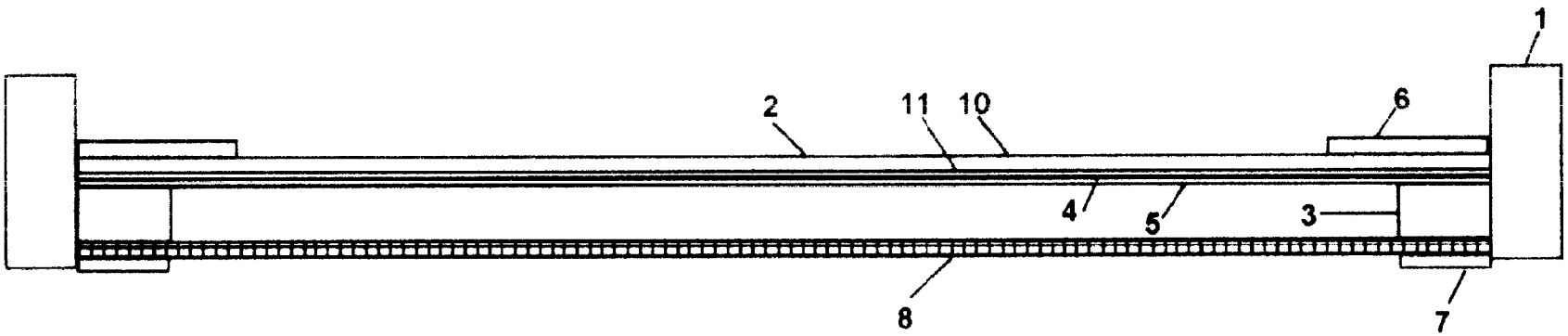
FIG. 3 is a cross sectional view of an alternate stained glass article taken along line I—I of FIG. 1
Figure 4:
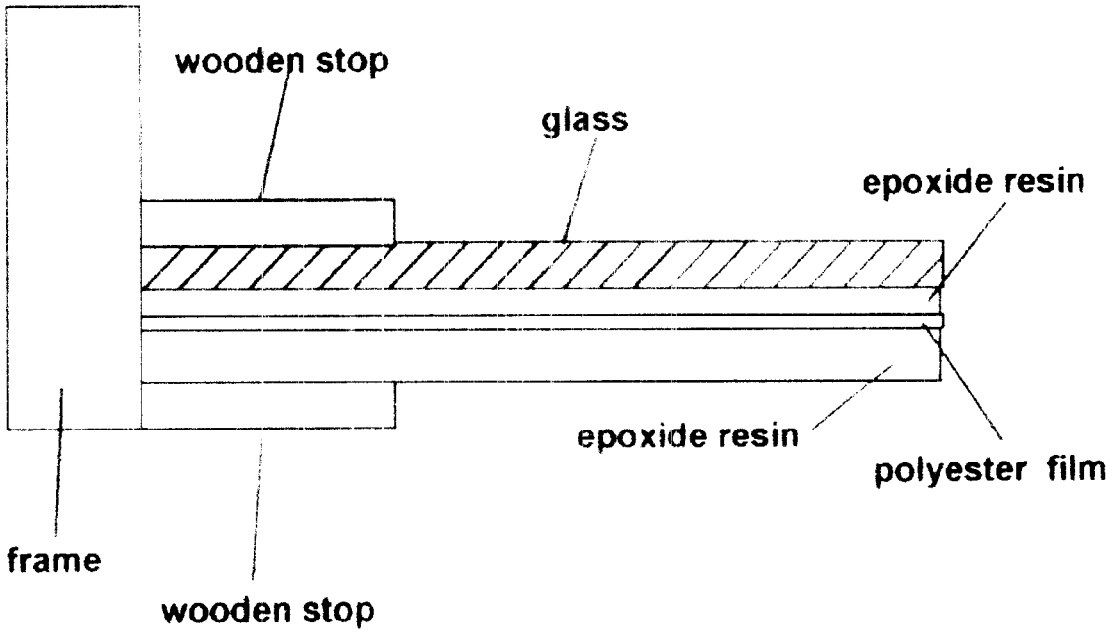
FIG. 4 is a cross-sectional view of a second alternative stained glass article.

In a further embodiment of the method of the present invention, articles are prepared according to FIG. 3. Frame elements 1 are deeper and there is additional space above the top of the embedding resin. The article is assembled according to the method of this present invention. The larger stops 3 were installed by the custom frame shop and resin has sealed the system beneath the stops. A portion of silvered mirror (⅛") 8 is placed on top of the stops with the silver surface of the mirror towards the resin embedding material. A new set of wooden stops 7 are installed to secure the mirror. The preferred embodiment for FIG. 3 substitutes Tru Vue Reflection Control glass for pane 2.

What is claimed is:

1. Method of producing a decorative, simulated stained glass article comprised of one pane of glass and at least two other layers, the method comprising:

providing art work or images generated by direct photography or by copying the images or art work, loading the images into a computer by scanning the images or by direct electronic uploading, printing the images onto at least one side of a polyester transparency film using an inkjet printer, providing a wooden picture frame having a glass pane located therein and cleaning the glass pane of the frame, mixing a two part epoxy resin for embedding the printed images transparency film, embedding the transparency film with the at least one side having the printed images contained thereon adjacent to the glass pane, placing a silvered mirror behind the transparency film to reflect light transmitted through the images on the transparency film from a viewing side of the mirror, and allowing the resin to cure, wherein the glass, frame, transparency, and mirror are sealed in the resin.

2. The method of claim 1, further comprising substituting polyester as the embedding resin.

3. The method of claim 1, wherein the glass pane is replaced with a pane of conservation glass having a protective UV coating.

4. The method of claim 1, further comprising substituting mylar as the transparency film.

* * * * *